US010201733B2

(12) United States Patent
Seluga et al.

(10) Patent No.: US 10,201,733 B2
(45) **Date of Patent: *Feb. 12, 2019**

(54) GOLF CLUB HEAD WITH STRUCTURAL COLUMNS

(71) Applicant: Callaway Golf Company, Carlsbad, CA (US)

(72) Inventors: James A. Seluga, Carlsbad, CA (US); Matthew Myers, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 3 days.

This patent is subject to a terminal disclaimer.

(21) Appl. No.: 15/717,635

(22) Filed: Sep. 27, 2017

(65) Prior Publication Data

US 2018/0015338 A1 Jan. 18, 2018

Related U.S. Application Data

(63) Continuation of application No. 15/637,902, filed on Jun. 29, 2017, now Pat. No. 9,981,167, which is a continuation of application No. 15/446,754, filed on Mar. 1, 2017, now Pat. No. 9,694,257, which is a continuation-in-part of application No. 15/279,188, (Continued)

(51) Int. Cl.
*A63B 53/04* (2015.01)
*A63B 60/42* (2015.01)

(52) U.S. Cl.
CPC ..... *A63B 53/0466* (2013.01); *A63B 53/047* (2013.01); *A63B 53/0475* (2013.01); *A63B 60/42* (2015.10); *A63B 2053/042* (2013.01); *A63B 2053/045* (2013.01); *A63B 2053/0408* (2013.01); *A63B 2053/0412* (2013.01); *A63B 2053/0416* (2013.01); *A63B 2053/0433* (2013.01); *A63B 2053/0437* (2013.01); *A63B 2053/0458* (2013.01);

(Continued)

(58) Field of Classification Search
CPC ..... A63B 53/0466; A63B 53/0475; A63B 53/047; A63B 2053/0412; A63B 2053/0408; A63B 2053/0437; A63B 2053/0433; A63B 2053/045; A63B 2053/0416; A63B 2053/042; A63B 2053/0458; A63B 2053/0491; A63B 2209/00; A63B 2209/023; A63B 60/42
USPC ..... 473/324–350, 287–292
See application file for complete search history.

(56) References Cited

U.S. PATENT DOCUMENTS 9,486,677 B1 * 11/2016 Seluga ..... A63B 53/0466
9,597,558 B1 * 3/2017 Seluga ..... A63B 53/0466

(Continued)

*Primary Examiner* — Sebastiano Passaniti
(74) *Attorney, Agent, or Firm* — Rebecca Hanovice; Michael Catania; Sonia Lari

(57) ABSTRACT

A golf club head having at least one structural column is disclosed herein. A body comprises a face section, a sole section, and a crown or return section, and defines a hollow interior. Each of the structural columns extends from the crown or return section to the sole section within the hollow interior to reduce stresses placed on the face section during impact with a golf ball. The structural columns are all located within 1 inch of a rear surface of the face section measured along a plane normal to the center of the face, and are spaced a distance of 0.500 to 2.00 inch from one another within the hollow interior.

19 Claims, 19 Drawing Sheets

Related U.S. Application Data filed on Sep. 28, 2016, now Pat. No. 9,687,701, which is a continuation of application No. 14/847,227, filed on Sep. 8, 2015, now Pat. No. 9,486,677, which is a continuation-in-part of application No. 14/285,479, filed on May 22, 2014, now Pat. No. 9,211,451, which is a continuation-in-part of application No. 13/788,173, filed on Mar. 7, 2013, now Pat. No. 8,926,448, said application No. 14/847,227 is a continuation-in-part of application No. 14/794,578, filed on Jul. 8, 2015, now Pat. No. 9,814,947, and a continuation-in-part of application No. 14/788,326, filed on Jun. 30, 2015, now Pat. No. 9,597,558, which is a continuation-in-part of application No. 14/755,068, filed on Jun. 30, 2015, now Pat. No. 9,623,302, which is a continuation-in-part of application No. 14/498,843, filed on Sep. 26, 2014, now Pat. No. 9,259,627, which is a continuation-in-part of application No. 14/173,615, filed on Feb. 5, 2014, now Pat. No. 9,180,349, which is a continuation-in-part of application No. 14/039,102, filed on Sep. 27, 2013, now Pat. No. 8,834,294, which is a continuation of application No. 13/797,404, filed on Mar. 12, 2013, now abandoned.

(60) Provisional application No. 61/898,956, filed on Nov. 1, 2013, provisional application No. 61/665,203, filed on Jun. 27, 2012, provisional application No. 61/684,079, filed on Aug. 16, 2012.

(52) U.S. Cl.
CPC ... *A63B 2053/0491* (2013.01); *A63B 2209/00* (2013.01); *A63B 2209/023* (2013.01)

(56) References Cited

U.S. PATENT DOCUMENTS

| | | | | |
|---|---|---|---|---|
| 9,597,561 | B1 * | 3/2017 | Seluga | A63B 53/06 |
| 9,687,701 | B1 * | 6/2017 | Seluga | A63B 53/0466 |
| 9,687,702 | B1 * | 6/2017 | Seluga | A63B 53/0466 |
| 9,694,257 | B1 * | 7/2017 | Seluga | A63B 53/0475 |
| 9,757,629 | B2 * | 9/2017 | Seluga | A63B 53/0466 |
| 9,776,058 | B2 * | 10/2017 | Seluga | A63B 53/0466 |
| 9,814,947 | B1 * | 11/2017 | Seluga | A63B 53/0466 |
| 9,821,199 | B1 * | 11/2017 | Seluga | A63B 53/0466 |
| 9,855,476 | B2 * | 1/2018 | Seluga | A63B 53/0466 |
| 9,889,349 | B1 * | 2/2018 | Seluga | A63B 53/0466 |
| 9,908,016 | B2 * | 3/2018 | Seluga | A63B 53/0466 |
| 9,908,017 | B2 * | 3/2018 | Seluga | A63B 53/0466 |
| 9,931,549 | B1 * | 4/2018 | Seluga | A63B 53/0466 |
| 9,981,167 | B2 * | 5/2018 | Seluga | A63B 53/0475 |

* cited by examiner

GOLF CLUB HEAD WITH STRUCTURAL COLUMNS

CROSS REFERENCES TO RELATED APPLICATIONS

The present application is a continuation application of U.S. patent application Ser. No. 15/637,902, filed on Jun. 29, 2017, which is a continuation application of U.S. patent application Ser. No. 15/446,754, filed on Mar. 1, 2017, now U.S. Pat. No. 9,694,257, issued on Jul. 4, 2017, which is a continuation-in-part application of U.S. patent application Ser. No. 15/279,188, filed on Sep. 28, 2016, now U.S. Pat. No. 9,687,701, issued on Jun. 27, 2017, which is a continuation application of U.S. patent application Ser. No. 14/847,227, filed on Sep. 8, 2015, now U.S. Pat. No. 9,486,677, issued on Nov. 8, 2016, which is a continuation-in-part application of U.S. patent application Ser. No. 14/285,479, filed on May 22, 2014, and issued on Dec. 15, 2015, as U.S. Pat. No. 9,211,451, which is a continuation-in-part application of U.S. patent application Ser. No. 13/788,173, filed on Mar. 7, 2013, and issued on Jan. 6, 2015, as U.S. Pat. No. 8,926,448, and also is a continuation-in-part application of U.S. patent application Ser. No. 14/794,578, filed on Jul. 8, 2015, and also is a continuation-in-part application of U.S. patent application Ser. No. 14/788,326 filed on Jun. 30, 2015, now U.S. Pat. No. 9,597,558, issued on Mar. 21, 2017, which is a continuation-in-part of U.S. patent application Ser. No. 14/755,068, filed on Jun. 30, 2015, now U.S. Pat. No. 9,623,302, issued on Apr. 18, 2017, which is a continuation-in-part application of U.S. patent application Ser. No. 14/498,843 filed on Sep. 26, 2014, now U.S. Pat. No. 9,259,627, issued on Feb. 16, 2016, which is a continuation-in-part application of U.S. patent application Ser. No. 14/173,615, filed on Feb. 5, 2014, now U.S. Pat. No. 9,180,349, issued on Nov. 10, 2015, which claims priority to U.S. Provisional Patent Application No. 61/898,956, filed on Nov. 1, 2013, and which is a continuation-in-part application of U.S. patent application Ser. No. 14/039,102, filed on Sep. 27, 2013, now U.S. Pat. No. 8,834,294, issued on Sep. 16, 2014, which is a continuation application of U.S. patent application Ser. No. 13/797,404, filed on Mar. 12, 2013, now abandoned, which claims priority to U.S. Provisional Patent Application Nos. 61/665,203, filed on Jun. 27, 2012, and 61/684,079 filed on Aug. 16, 2012, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head. More specifically, the present invention relates to a golf club head with stress-reducing features connecting a crown portion with a sole portion via a hollow interior and disposed proximate a striking face section.

Description of the Related Art

The prior art discloses various golf club heads having interior structures. For example, Kosmatka, U.S. Pat. No. 6,299,547 for a Golf Club Head With an Internal Striking Plate Brace, discloses a golf club head with a brace to limit the deflection of the striking plate, Yabu, U.S. Pat. No. 6,852,038 for a Golf Club Head And Method of Making The Same, discloses a golf club head with a sound bar, Galloway, U.S. Pat. No. 7,118,493 for a Multiple Material Golf Club Head, discloses a golf club head with a composite aft body having an interior sound component extending upward from a sole section of a metal face component, Seluga et al., U.S. Pat. No. 8,834,294 for a Golf Club Head With Center Of Gravity Adjustability, discloses a golf club head with a tube having a mass for adjusting the CG of a golf club head, and Dawson et al., U.S. Pat. No. 8,900,070 for a Weighted Golf Club Head discloses a golf club head with an interior weight lip extending from the sole towards the face. However, the prior art fails to disclose an interior structure that increases ball speed through reducing stress in the striking face section at impact, with a minimal increase in mass to the golf club head.

BRIEF SUMMARY OF THE INVENTION

The golf club head comprises interior structures connecting a crown section to a sole section to reduce the stress in a striking face section during impact with a golf ball. In some embodiments, the interior structures are hollow tubes or solid rods composed of a titanium alloy.

One aspect of the present invention is a golf club head comprising a cast metal body. The cast metal body comprises a toe structural connector, a heel structural connector, a striking face section, a crown return portion and a sole section. The toe structural connector comprises a body with a crown end, a sole end, a forward surface, a rearward surface, a heel surface and a toe surface. The heel structural connector comprises a body with a crown end, a sole end, a forward surface, a rearward surface, a heel surface and a toe surface. The striking face section has an exterior surface, an interior surface, an upper perimeter and a lower perimeter. The crown return portion extends rearward from the upper perimeter of the striking face section. The sole section portion extends rearward from the lower perimeter of the striking face section. The crown end of the toe structural connector is connected to the crown return portion. The crown end of the heel structural connector is connected to the crown return portion. The sole end of the toe structural connector is connected to the sole section. The sole end of the heel structural connector is connected to the sole section. A contact surface area between the crown return portion and both of the crown end of the toe structural connector and the crown end of the heel structural connector ranges from 1% to 5% of the surface area of the crown return portion. The toe structural connector and the heel structural connector attenuate movement of the crown return portion and the sole section when the striking face section impacts a golf ball.

In some embodiments, each of the structural columns comprises a structure selected from the group consisting of a solid rod and a hollow tube. In another, further embodiment, each of the structural columns is a solid rod composed of a metal material selected from the group consisting of titanium alloy and steel. In an alternative embodiment, each of the structural columns is located no more than 0.25 inch from the rear face surface along the vertical plane extending through the face center perpendicular to the striking face section.

Another aspect of the current invention is golf club head comprising a metal body comprising a striking face section, a sole section extending from a lower edge of the striking face section, and a return section extending from an upper edge of the striking face section, the return section and sole section defining an upper opening, and the striking face section, sole section, and return section defining a hollow body interior, and first and second structural columns disposed within the hollow body interior and extending from the return section to the sole section, wherein each of the first and second structural columns is a solid metal rod, wherein no portion of either the first or second structural columns makes contact with the striking face section, wherein the golf club head satisfies the equation $V_{ballnorm} \geq 0.0356$ x+140.82, and wherein $$V_{ballnorm} = \frac{m_h V_{inh} + m_h V_{inh} \left[ \frac{V_{cr}}{V_{cin}}\left(1 + \frac{m_b}{m_c}\right) + \frac{m_b}{m_c} + \frac{V_{br}}{V_{bin}}\left(1 + \frac{m_b}{m_p}\right) + \frac{m_b}{m_p} - 0.822 \right]}{m_h + m_b}.$$

In a further embodiment, the golf club head may comprise a crown insert that may be permanently affixed to the body to close the upper opening. In some embodiments, the crown insert may be composed of a carbon composite material, and each of the first and second stiffening members may be integrally cast with the body.

Yet another aspect of the present invention is a golf club head comprising a metal body comprising a striking face section, a sole section extending from a lower edge of the striking face section, a return section extending from an upper edge of the striking face section, and an aft end opposite the striking face section, the return section and sole section defining an upper opening, and the striking face section, sole section, and return section defining a hollow body interior, first and second structural columns disposed within the hollow body interior and extending from the return section to the sole section, and a carbon composite crown insert permanently affixed to the body to close the upper opening, wherein each of the first and second structural columns is located closer to the striking face section than to the aft end within the hollow body interior, wherein the golf club head has a volume of 420 cubic centimeters to 470 cubic centimeters, wherein the golf club head satisfies the equation $V_{ballnorm} \geq 0.0356$ x+141.19, and wherein $$V_{ballnorm} = \frac{m_h V_{inh} + m_h V_{inh} \left[ \frac{V_{cr}}{V_{cin}}\left(1 + \frac{m_b}{m_c}\right) + \frac{m_b}{m_c} + \frac{V_{br}}{V_{bin}}\left(1 + \frac{m_b}{m_p}\right) + \frac{m_b}{m_p} - 0.822 \right]}{m_h + m_b}.$$

In some embodiments, the first structural connector comprises an upper end proximate the return section and a lower end proximate the sole section, the upper end is spaced a first distance from the striking face section, and the lower end is spaced a second distance from the striking face section that is greater than the first distance. In a further embodiment, the first distance is 0.120 inch to 0.150 inch, and the second distance is 0.180 inch to 0.210 inch. In another embodiment, each of the first and second structural columns has a length of 1.00 inch to 2.50 inches, the first structural connector extends approximately parallel with the second structural connector, and the first structural connector is spaced a distance of 0.75 inch to 1.50 inch from the second structural connector.

Having briefly described the present invention, the above and further objects, features, and advantages thereof will be recognized by those skilled in the pertinent art from the following detailed description of the invention when taken in conjunction with the accompanying drawings.

DETAILED DESCRIPTION OF THE INVENTION

Figure 1:
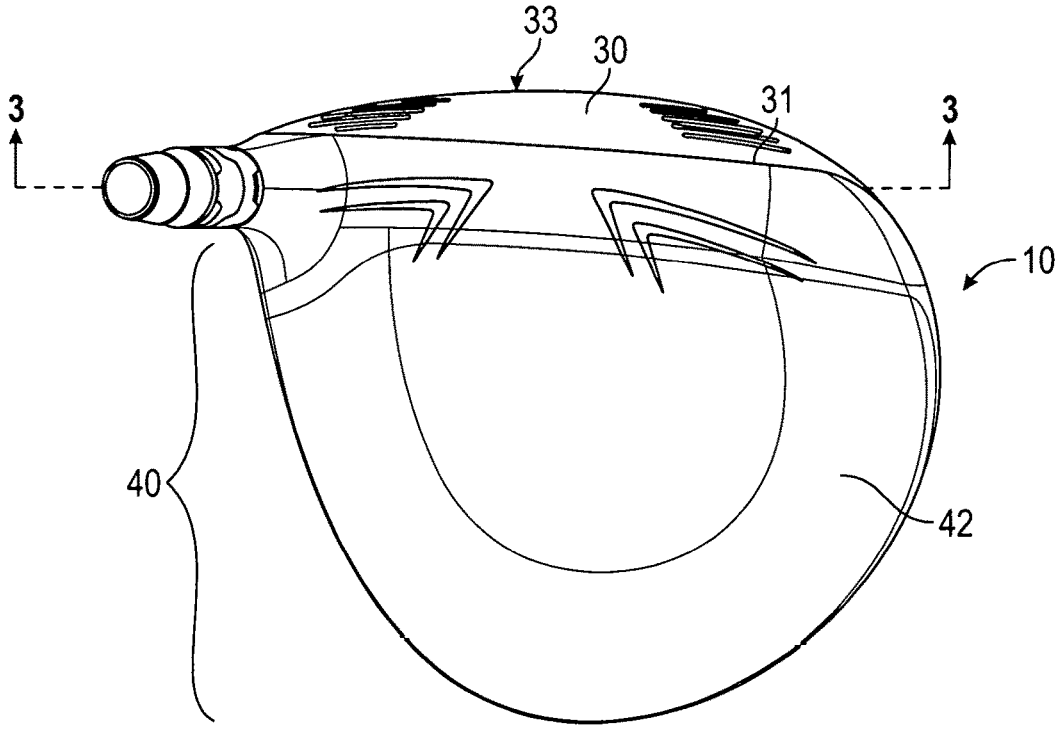
FIG. 1 is a top elevational view of the preferred embodiment of a golf club head with structural columns.
Figure 2:
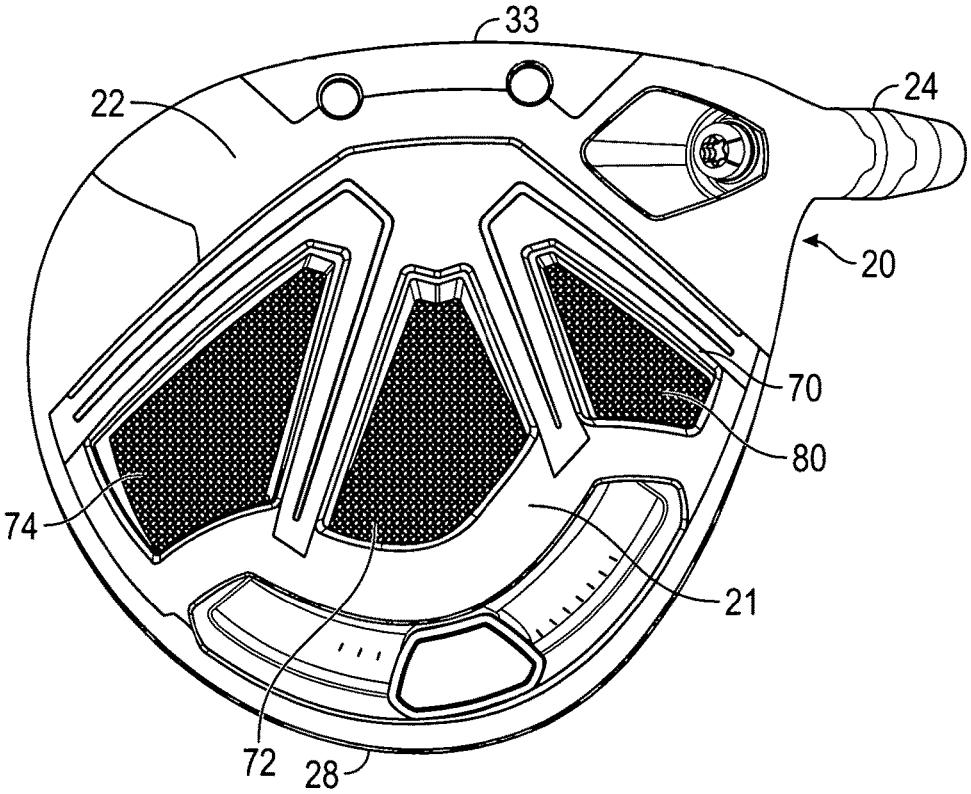
FIG. 2 is a sole elevational view of the golf club head shown in FIG. 1.

A preferred embodiment of the golf club head 10 with structural columns is shown in FIGS. 1-8. The golf club head 10 preferably includes a body 20 having a striking face section 30 with a face center 34, a return section 32 extending rearwards away from an upper edge 31 of the striking face section 30, sole section 22 extending rearwards away from a lower edge 33 of the striking face section 30, a hosel 24 for engaging a shaft, a heel end 23, a toe end 25, an upper opening 26, a hollow interior 27, and an aft end 28. A crown section 40 is comprised of the return section 32 and a crown insert 42 that is placed over the upper opening 26 to enclose the hollow interior 27. The body 20 also includes three cutouts 70, 72, 74 in a center area 21 of the sole section 22, which are closed by a cover piece 80 having a density that is lower than the density of the material used to make the body 20. Each of the crown section 40 and cover piece 80 preferably is composed of a carbon composite material, while the body 20 is composed of a metal material such as titanium alloy or steel.

Within the hollow interior 27, two structural columns 50, 52 extend from the sole section 22 upward to the return section 32 approximately parallel with the rear surface 36 of the striking face section 30 and with each other. In an alternative embodiment, the structural columns 50, 52 extend to the crown insert 42 instead; what is important is that the structural columns 50, 52 connect the crown section 40 to the sole section 22 proximate the striking face section 30, without making contact with any portion of the striking face section 30, even when the striking face section 30 impacts a golf ball. The structural columns 50, 52 must, in any event, be closer to the striking face section 30 than to the aft end 28 of the body 20.

Figure 3:
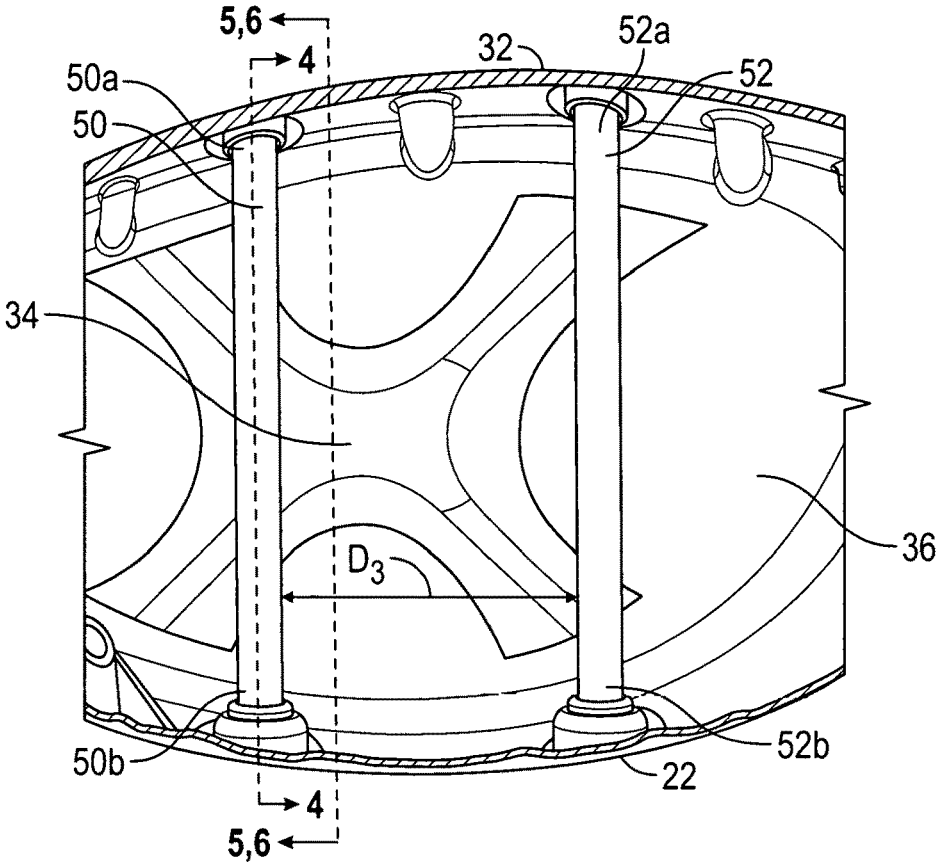
FIG. 3 is a cross-sectional view of the golf club head shown in FIG. 1 along lines 3-3.
Figure 4:
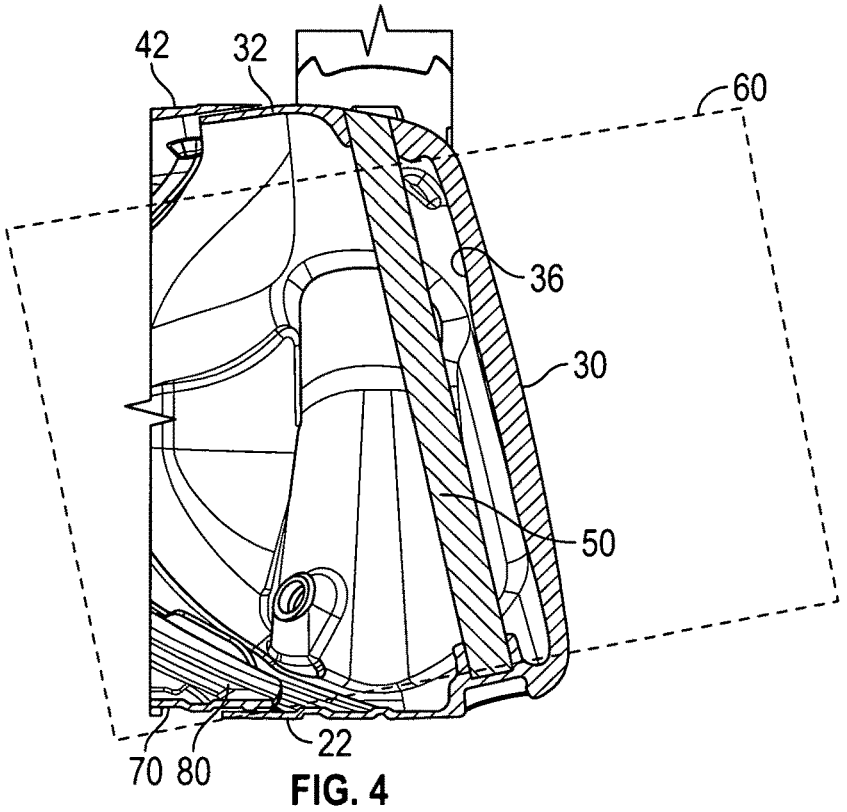
FIG. 4 is a cross-sectional view of the golf club head shown in FIG. 3 along lines 4-4.

As shown in FIG. 3, the preferred embodiment has two structural columns 50, 52, each of which is a solid rod composed of a lightweight, strong metal material such as titanium alloy or steel, though in an alternative embodiment the structural columns 50, 52 each may be a hollow tube or other hollow structure made of a strong lightweight metal or a composite material. In another embodiment, the golf club head 10 may include both the solid rod and hollow types of structural columns 50. The structural columns 50, 52 preferably are co-cast with the body 20 using a wax molding process, though in alternative embodiments may be added after the body 20 is manufactured and secured to the body 20 via welding, brazing, solder, or adhesive, and/or mechanically.

In the preferred embodiment, each of the structural columns 50, 52 has a diameter of 0.050 inch to 0.200 inch and a length of 1 to 2.5 inches. The structural columns 50, 52 are both preferably located within 1 inch of the rear surface 36 of the striking face section 30 measured along a vertical plane 60 extending through the face center 34 perpendicular to the striking face section 30. No portion of any structural columns 50, 52 should be located outside of this 1-inch range; in fact, it is more preferable for each structural connector 50, 52 to be located even closer to the rear surface 36 of the striking face section 30. In the preferred embodiment, the structural columns are spaced 0.136 inch to 0.210 inch from the rear surface 36, with the upper end 50*a*, 52*a* of each structural connector 50, 52 spaced a distance $D_1$ that is slightly closer to the rear surface 36 than the spacing $D_2$ of the lower end 50*b*, 52*b*. In the preferred embodiment, $D_1$ ranges from 0.120 inch to 0.150 inch, while $D_2$ ranges from 0.180 inch to 0.210 inch. The structural columns 50, 52 are also spaced from one another by a distance $D_3$ of 0.500 to 2.00 inch, more preferably approximately 0.75 to 1.50 inch, and most preferably approximately 1.00 inch. This positioning of the structural columns 50, 52 optimizes the normalized ball speed relationship to Characteristic Time (CT), as measured in μs by the U.S. Golf Association (USGA) CT test.

Figure 9:
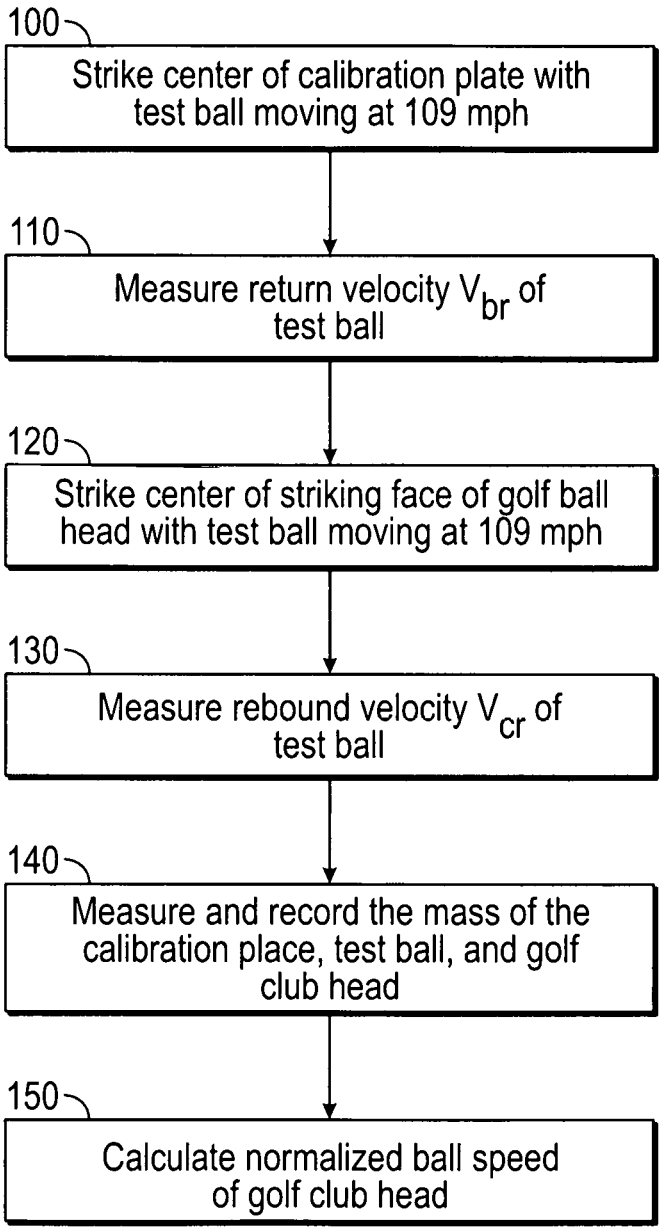
FIG. 9 is a flow chart describing how to calculate the normalized ball speed of a golf club head, including the embodiment shown in FIG. 1.

Normalized ball speed removes the variable effect of a golf club head's mass and loft, and the construction of a particular golf ball, from testing the speed of a golf ball upon impact with any given golf club head, including the golf club head 10 of the present invention; in other words, it allows an apples-to-apples comparison of golf club head performance. Normalized ball speed can be determined for a golf club head using the following steps, which are also outlined in the flow chart of FIG. 9.

Figure 10:
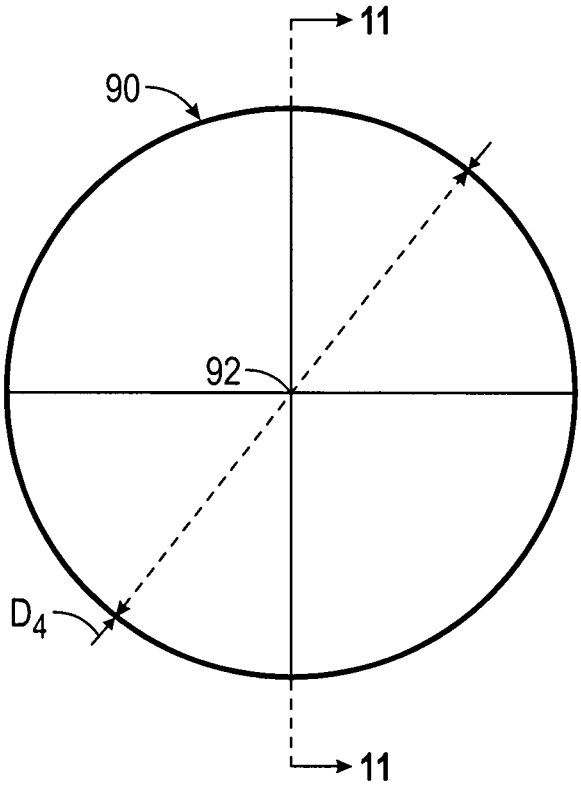
FIG. 10 is a top plan view of an exemplary calibration plate used to calculate normalized ball speed of a golf club head.
Figure 11:
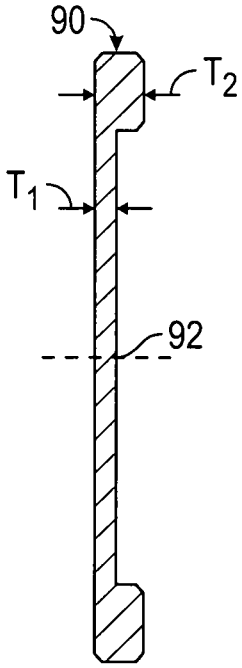
FIG. 11 is a cross-sectional view of the calibration plate shown in FIG. 10 along lines 11-11.

First, provide a titanium 6-4 calibration plate 90 with a mass of approximately 190 grams, a diameter $D_4$ of approximately 4 inches, a minimum thickness $T_1$ of approximately 0.100-0.150 inch, and a maximum thickness $T_2$ of approximately 0.200-0.400 inch, as shown in FIGS. 10 and 11, and strike the center 92 of the calibration plate with a test golf ball moving at approximately 109 mph (step 100). Measure the return velocity $V_{br}$ of the ball (step 110). Then, strike the same test golf ball, again traveling at approximately 109 mph, with the center 34 of the striking face section 30 of the golf club head 10 being assessed (step 120), and measure the rebound velocity $V_{cr}$ of the test golf ball (step 130). Next, measure and record the mass of the plate $m_p$, golf ball $m_b$, golf club head 10 $m_c$, measured head test ball in velocity (109 mph target) $V_{cin}$, measured plate test ball in velocity (109 mph target) $V_{bin}$, measured head test ball return velocity $V_{cr}$, and measured plate test ball return velocity $V_{br}$ (step 140). Finally, calculate the normalized ball speed ($V_{ballnorm}$) using the following equation (step 150):

$$V_{ballnorm} = \frac{m_h V_{inh} + m_h V_{inh} \left[ \frac{V_{cr}}{V_{cin}}\left(1 + \frac{m_b}{m_c}\right) + \frac{m_b}{m_c} + \frac{V_{br}}{V_{bin}}\left(1 + \frac{m_b}{m_p}\right) + \frac{m_b}{m_p} - 0.822 \right]}{m_h + m_b}$$

In this equation, $V_{inh}$ is 100 and $m_h$ is 200.

Figure 12:
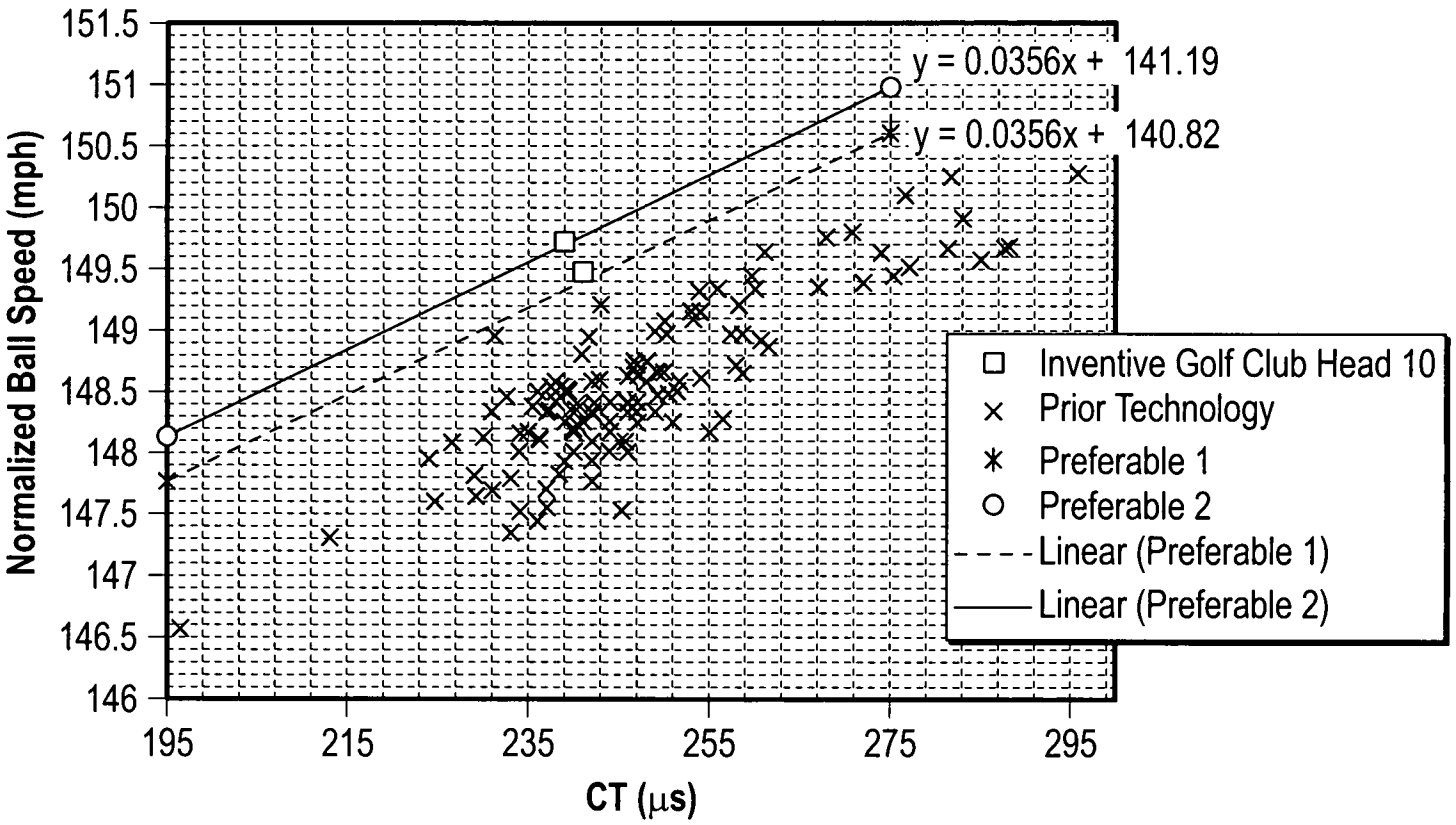
FIG. 12 is a graph showing the relationship between normalized ball speed (y-axis) and Characteristic Time (μs) (x-axis) of prior art golf club heads and the golf club head described herein.
Figure 13:
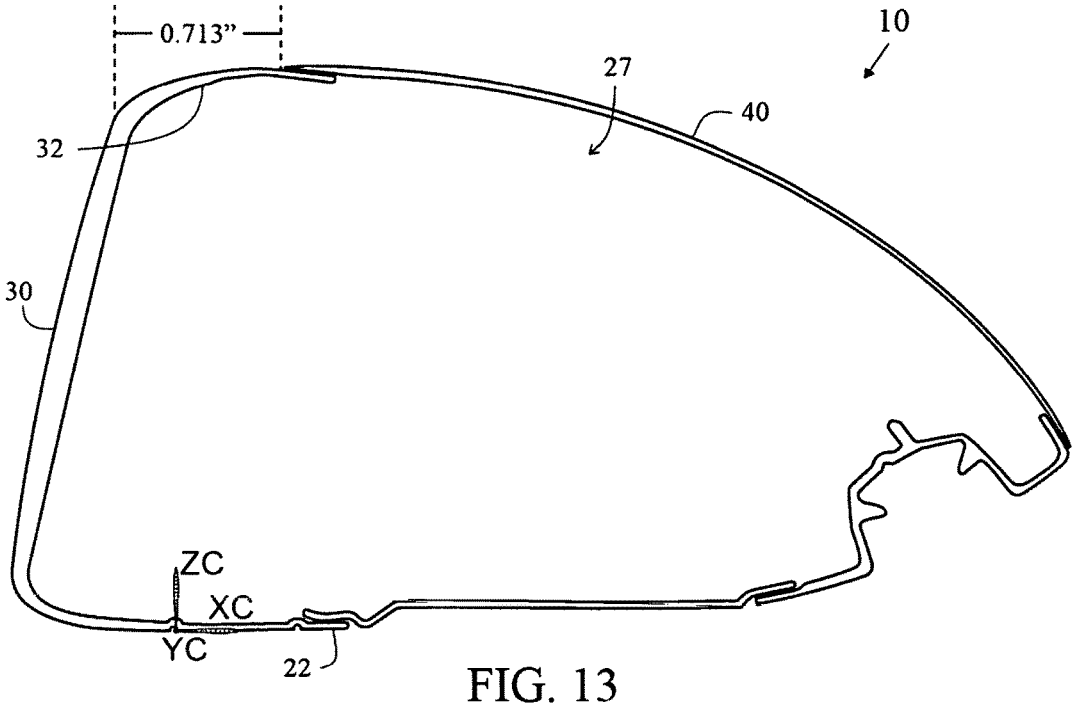
FIG. 13 is a cross-sectional view of a golf club head.

The golf club head 10 of the present invention has a $V_{ballnorm} \geq 0.0356$ x+140.82, and more preferably a $V_{ballnorm} \geq 0.0356$ x+141.19. The positioning of the structural columns 50, 52 allow the golf club head 10 to satisfy this equation; as shown in FIG. 12, prior art golf club heads, which do not include the structural connector structure, fall well short of this performance metric.

In addition to optimizing the normalized ball speed of the golf club head 10, locating the stiffening members 50, 52 within the region of the golf club head 10 defined above has the greatest stress-reducing effect on the golf club head 10. If any of the structural columns 50, 52 are placed more than 1 inch away from the rear surface 36 of the striking face section 30, they will not have a noticeable effect on the stress placed on the striking face section 30 when the golf club head 10 is in use, and will use discretionary mass without providing a significant performance benefit.

FIGS. 13-19 illustrate the contact surface area 55*a* and 55*b* between each of the structural connecting 50 and 52 and the return section 32 of the body 20 of the golf club head 10.

The cast metal body 20 preferably comprises a toe structural connector 52, a heel structural connector 50, a striking face section 30, a crown return portion 32 and a sole section 22.

Figure 3A:
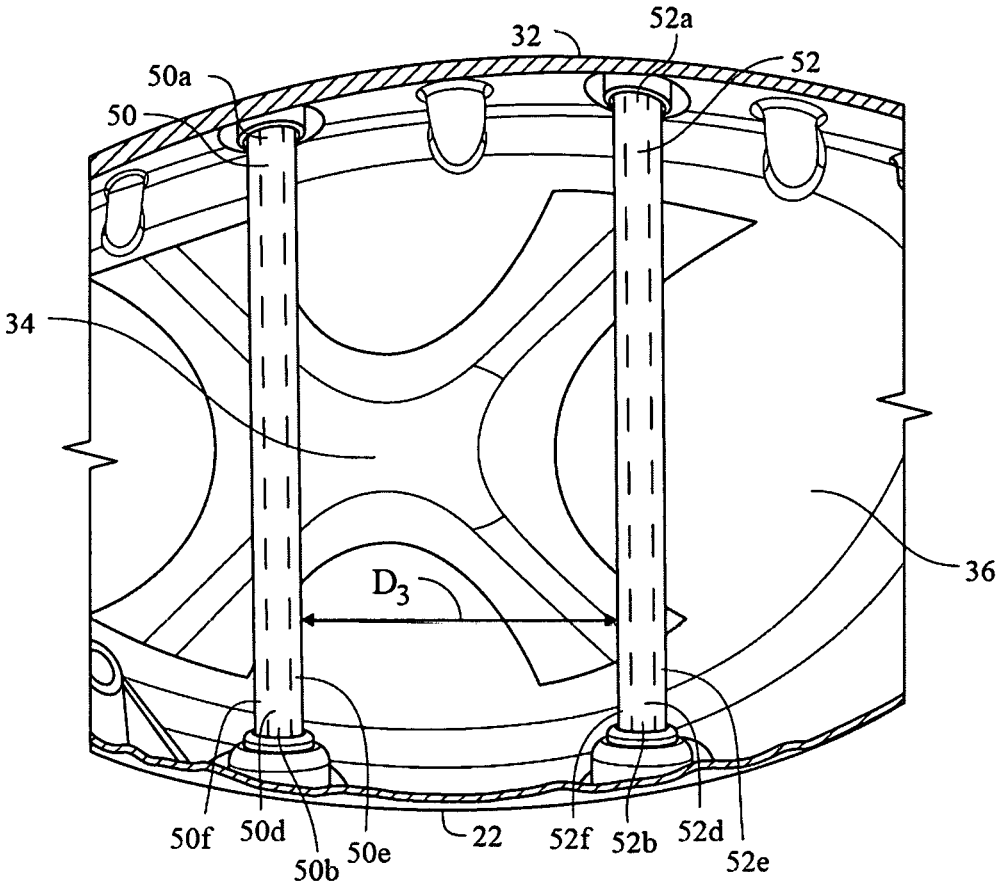
FIG. 3A is a cross-sectional view of the golf club head shown in FIG. 1 along lines 3-3 illustrating the surfaces of the structural columns.
Figure 19:
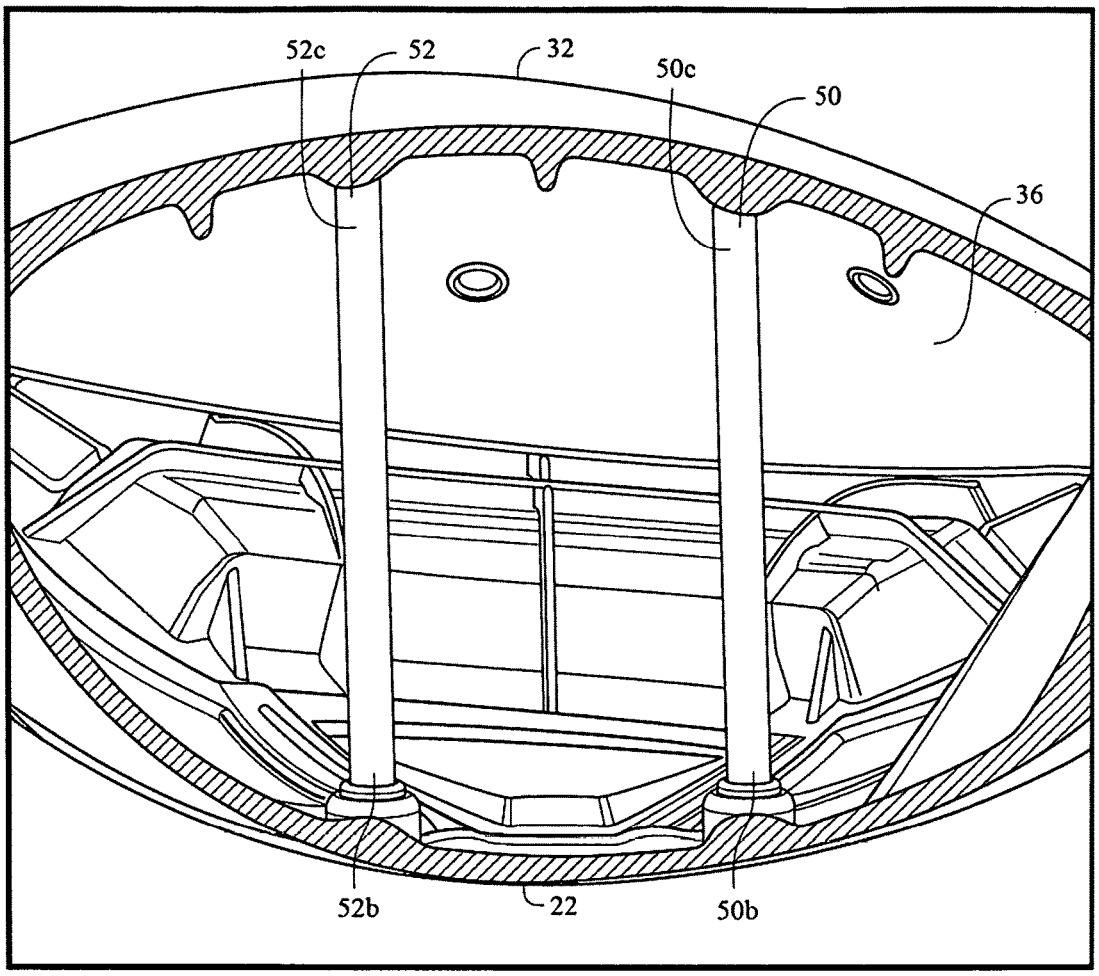
FIG. 19 is a front elevation view of a golf club head with structural columns with a face removed to illustrate the interior of the golf club head.

In one embodiment, shown in FIGS. 3A and 19, the toe structural connector 52 comprises a body with a crown end 52*a*, a sole end 52*b*, a forward surface 52*c* (shown in FIG. 19), a rearward surface 52*d*, a heel surface 52*f* and a toe surface 52*e*. The heel structural connector 50 comprises a body with a crown end 50*a*, a sole end 50*b*, a forward surface 50*c* (shown in FIG. 19), a rearward surface 50*d*, a heel surface 50*f* and a toe surface 50*e*. In this embodiment, each of the heel structural connector 50 and the toe structural connector 52 has a radius of curvature preferably ranging from 0.02 inch to 0.1 inch, more preferably from 0.025 inch to 0.05 inch, and most preferably 0.0395 inch. The striking face section 30 has an exterior surface 30*a*, an interior surface 36, an upper perimeter 31 and a lower perimeter 33. The crown return portion 32 extends rearward from the upper perimeter 31 of the striking face section 30 preferably approximately 0.5 inch to 1.5 inches, more preferably 0.6 inch to 1.0 inch, and most preferably approximately 0.725 inch. The sole section 22 portion extends rearward from the lower perimeter 33 of the striking face section 30. The crown end 52*a* of the toe structural connector 52 is connected to the crown return portion 32. The crown end 50*a* of the heel structural connector 50 is connected to the crown return portion 32. The sole end 52*b* of the toe structural connector 52 is connected to the sole section 22. The sole end 50*a* of the heel structural connector 50 is connected to the sole section 22.

Figure 17:
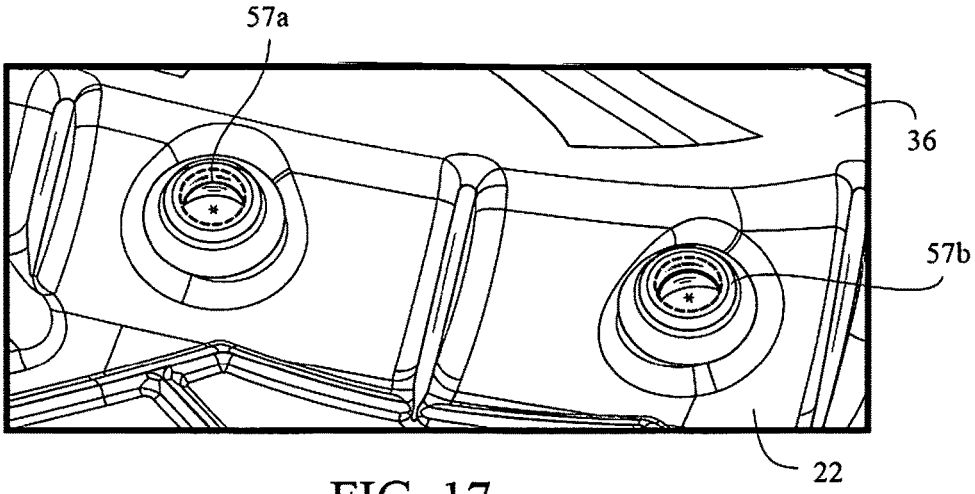
FIG. 17 is an isolated internal view of a golf club head.
Figure 18:
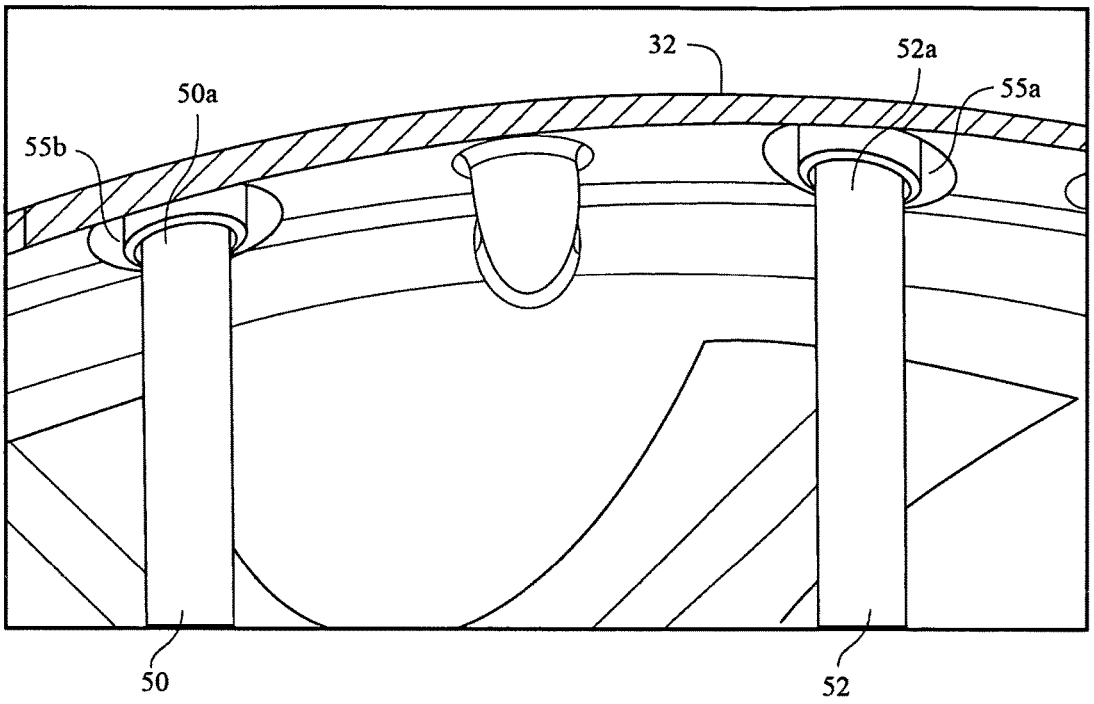
FIG. 18 is an isolated internal view of an intersection of the structural columns and a return section of a golf club head.

A contact surface area 57*a*, 57*b* between the crown return portion 32 and both of the crown end 52*a* of the toe structural connector 52 and the crown end 50*a* of the heel structural connector 50*a* ranges from 1% to 5% of the surface area of the crown return portion 32. The surface area of the crown return portion ranges from 2.5 square inches to 4.0 square inches. The contact surface area 55*a* between the crown return portion 32 and the crown end 52*a* of the toe structural connector 52 preferably ranges from 0.02 square inches to 0.1 square inch, more preferably from 0.035 square inch to 0.075 square inch, and most preferably is 0.045 square inch. As shown in FIG. 18, the contact surface area 55*b* between the crown return portion 32 and the crown end 50*a* of the heel structural connector 50 preferably ranges from 0.02 square inches to 0.1 square inch, more preferably from 0.035 square inch to 0.075 square inch, and most preferably is 0.045 square inch. As shown in FIG. 17, the contact surface area 57*a* between the sole section 22 and the sole end 52*b* of the toe structural connector 52 preferably ranges from 0.015 square inches to 0.1 square inch, more preferably from 0.025 square inch to 0.05 square inch, and most preferably is 0.03 square inch. The contact surface area 57*b* between the sole section 22 and the sole end 50*b* of the heel structural connector 50 preferably ranges from 0.015 square inches to 0.1 square inch, more preferably from 0.025 square inch to 0.05 square inch, and most preferably is 0.03 square inch.

The toe structural connector 52 and the heel structural connector 50 preferably attenuate movement of the crown return portion 32 and the sole section 22 when the striking face section 30 impacts a golf ball.

The toe structural connector 52 and the heel structural connector 50 each preferably have a length from the sole end 50*b*, 52*b* to the crown end 50*a*, 52*a* ranging from 1 inch to 2.5 inches. As shown in FIG. 3A, the heel surface 52*f* of the toe structural connector 52 is a distance ranging from 0.75 inch to 1.5 inches from the toe surface 50*e* of the heel structural connector 50. A contact area 55*a*, 55*b*, between the crown return portion 32 and each of the toe structural connector 52 and the heel structural connector 50 preferably ranges from 0.02 square inches to 0.04 square inches.

Figure 5:
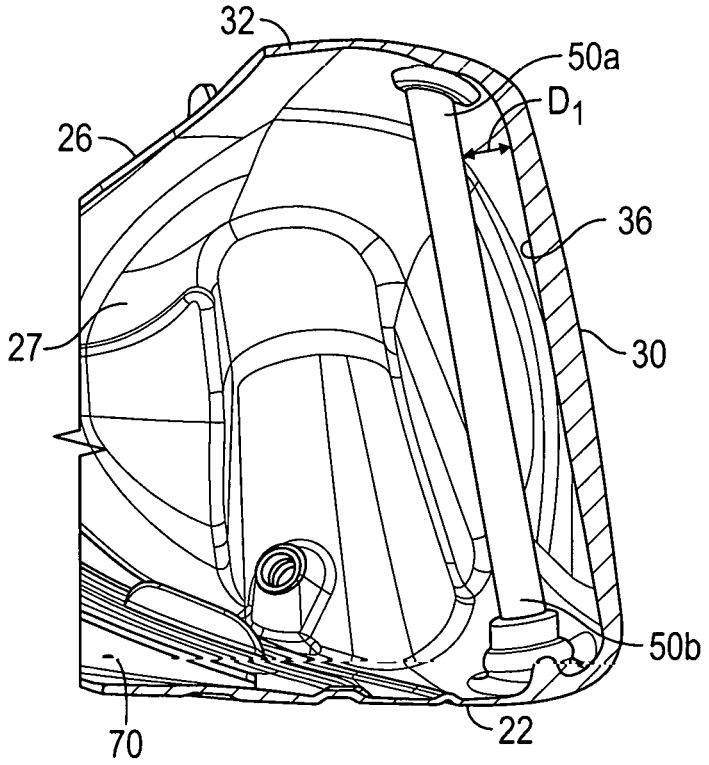
FIG. 5 is a cross-sectional view of the golf club head shown in FIG. 3 along line 5-5.
Figure 5A:
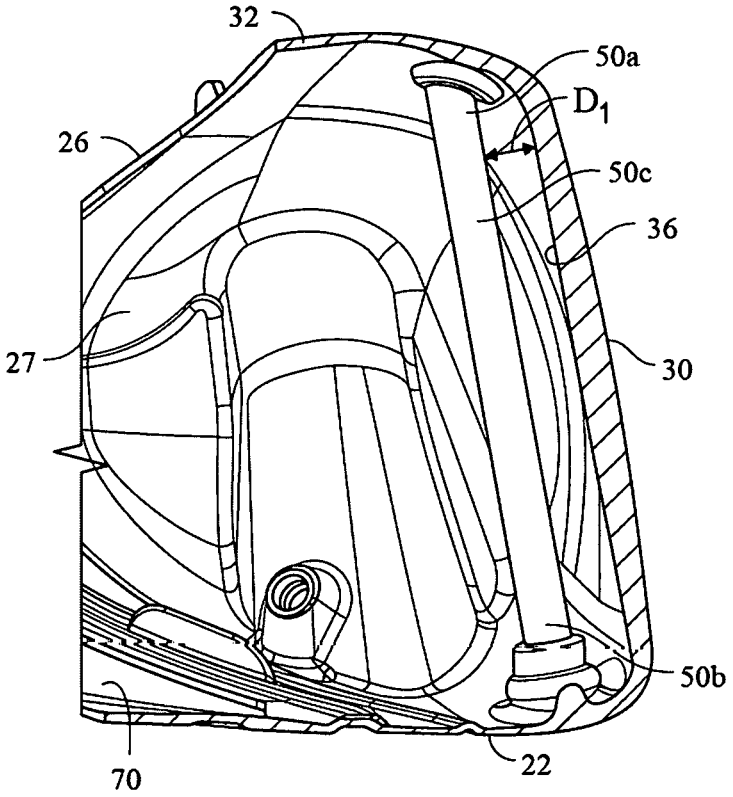
FIG. 5A is a cross-sectional view of the golf club head shown in FIG. 3 along line 5-5.

As shown in FIG. 5A, the forward surface 50*c* and 52*c* of each of the toe structural connector 52 and the heel structural connector 50 is at least 0.120 inch rearward from the interior surface 36 of the striking face section 30 and the rearward surface 50*d*, 52*d* of each of the toe structural column 52 and the heel structural column 50 is no more than 1.0 inch rearward from the interior surface 36 of the striking face section 30.

When the golf club head 10 is designed as a driver, it preferably has an external volume from 200 cubic centimeters to 600 cubic centimeters, more preferably from 300 cubic centimeters to 500 cubic centimeters, and most preferably from 420 cubic centimeters to 470 cubic centimeters, with a most preferred volume of 460 cubic centimeters. In the preferred embodiment, the golf club head 10 has an external volume of approximately 450 cc to 460 cc.

When the golf club head 10 is designed as a driver, it preferably has an internal volume from 300 cubic centimeters to 420 cubic centimeters, more preferably from 380 cubic centimeters to 400 cubic centimeters, and most preferably an internal volume of 391 cubic centimeters. The toe structural column 52 and the heel structural column 50 preferably have a combined volume from 0.5 cc to 4.0 cc, more preferably from 1. cc to 2.5 cc, and most preferably 1.5 cc. The toe structural column 52 and the heel structural column 50 preferably occupy from 0.1% to 1.0% of the internal volume of the golf cub head 10, more preferably from 0.25% to 0.5% of the internal volume of the golf cub head 10, and most preferably 0.3% of the internal volume of the golf cub head 10.

The external volume of the golf club head 10 also varies between fairway woods (preferably ranging from 3-woods to eleven woods) with smaller volumes than drivers. When designed as a driver, the golf club head 10 preferably has a mass of no more than 215 grams, and most preferably a mass of 180 to 215 grams; when designed as a fairway wood, the golf club head 10 preferably has a mass of 135 grams to 200 grams, and preferably from 140 grams to 165 grams.

Figure 3B:
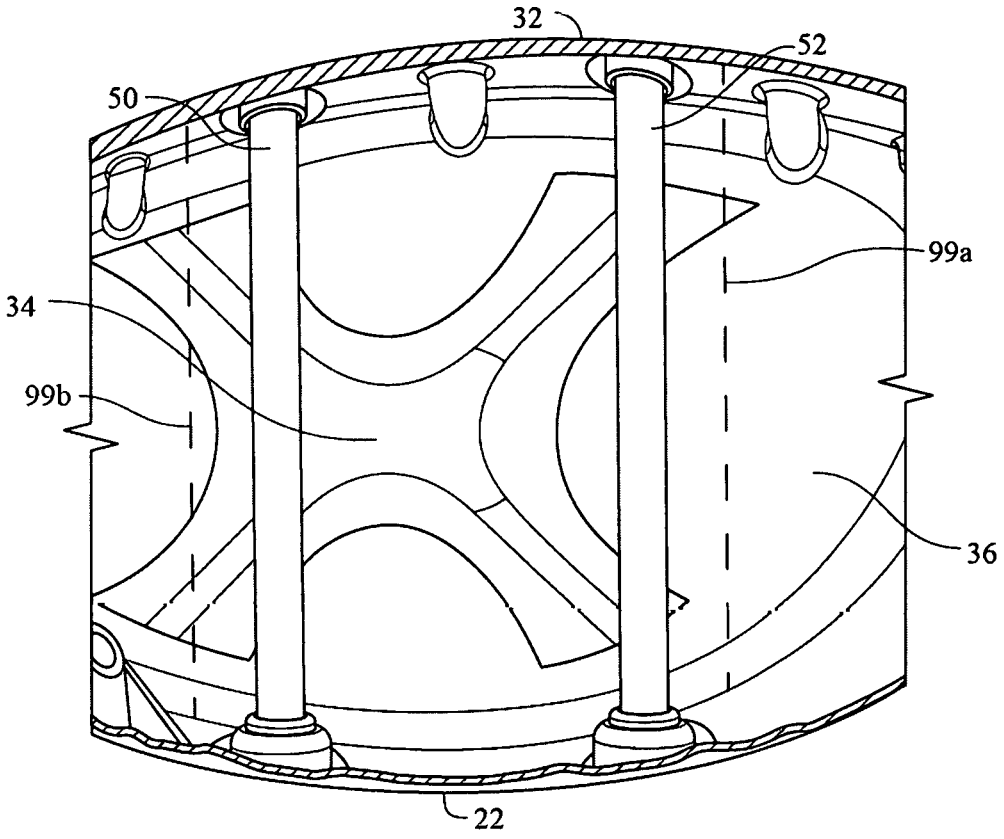
FIG. 3B is a cross-sectional view of the golf club head shown in FIG. 1 along lines 3-3 illustrating part of an imaginary cube encompassing the structural columns.
Figure 6:
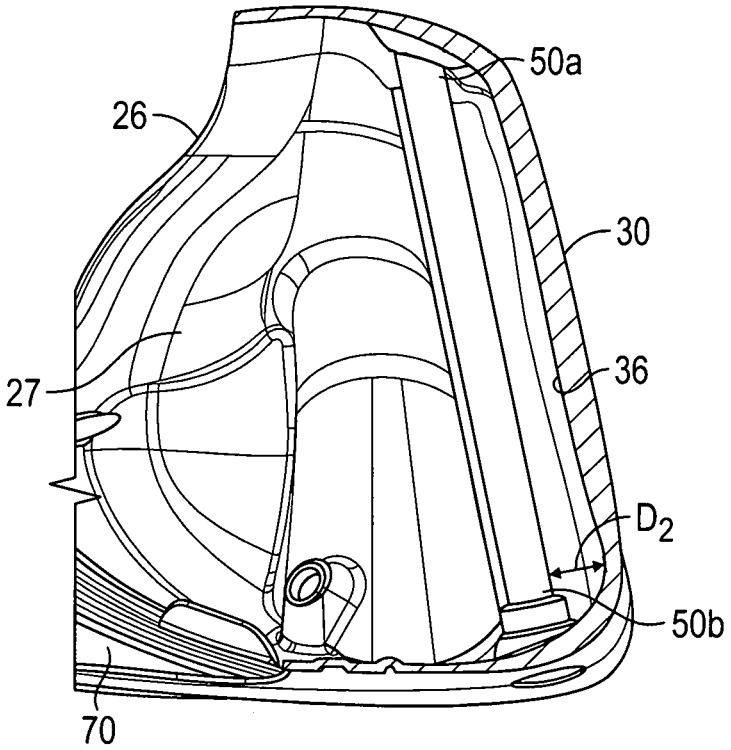
FIG. 6 is a cross-sectional view of the golf club head shown in FIG. 3 along line 6-6.
Figure 5B:
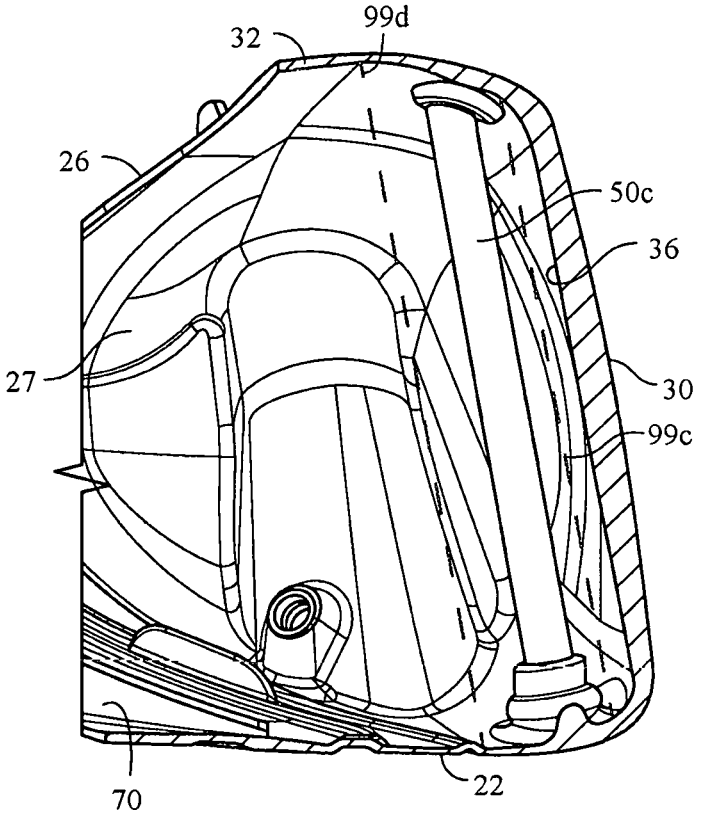
FIG. 5B is a cross-sectional view of the golf club head shown in FIG. 3 along line 5-5 illustrating part of an imaginary cube encompassing the structural columns.
Figure 7:
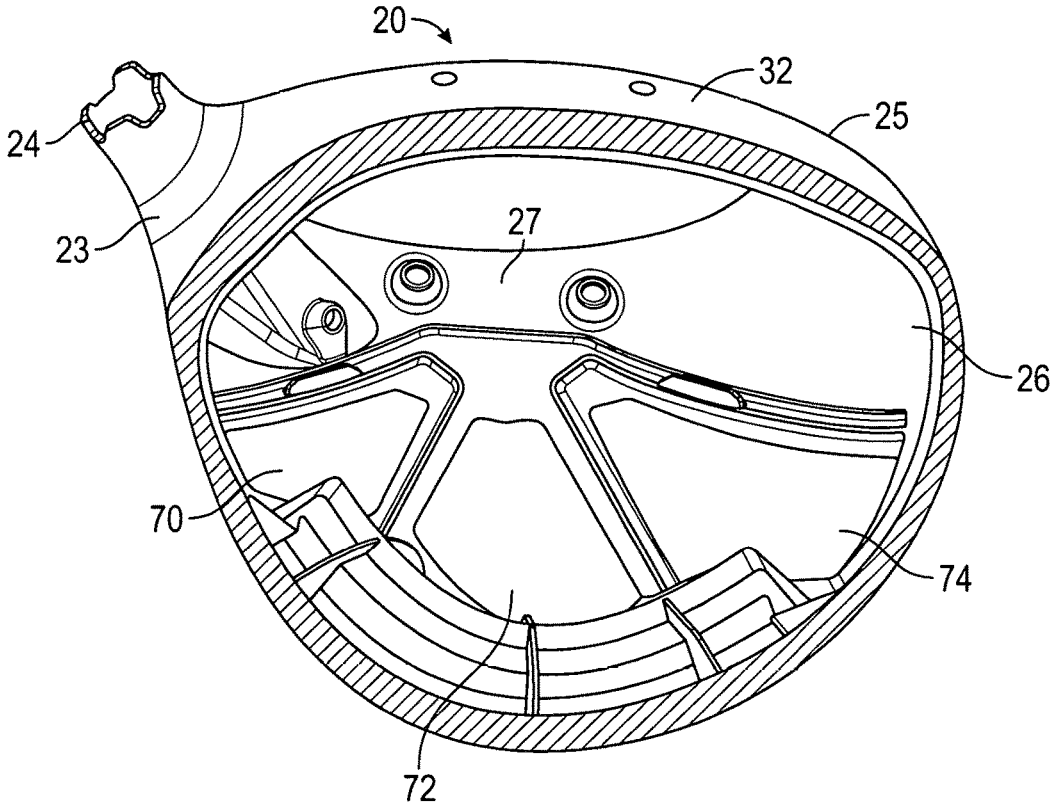
FIG. 7 is a top perspective view of the golf club head shown in FIG. 1 with its crown insert and sole cover piece removed.
Figure 8:
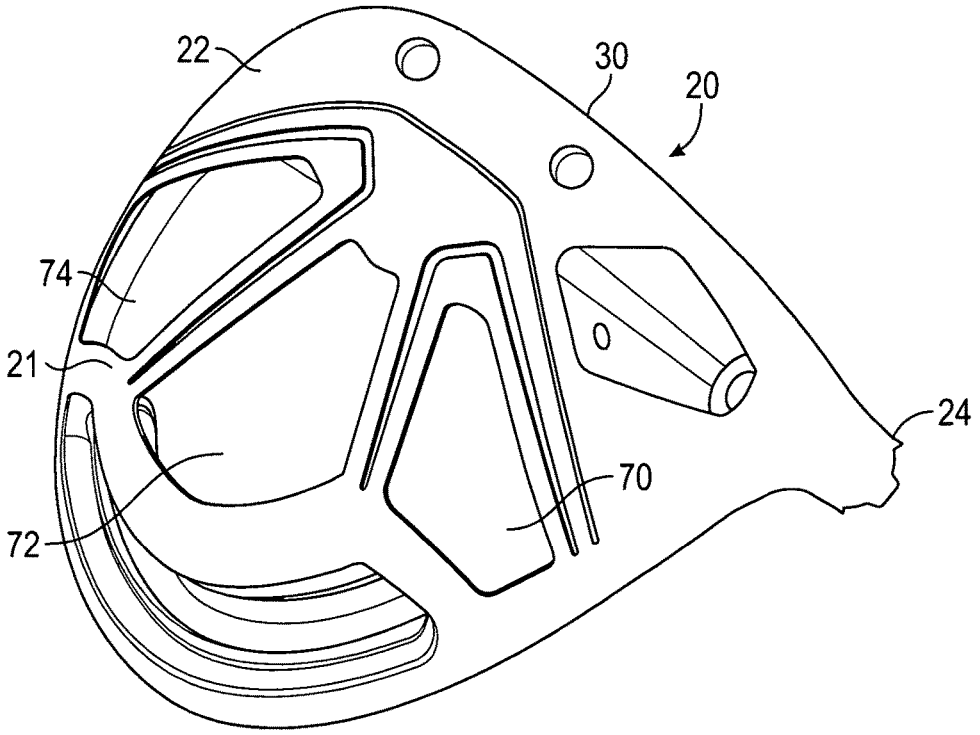
FIG. 8 is a sole perspective view of the embodiment shown in FIG. 7.
Figure 14:
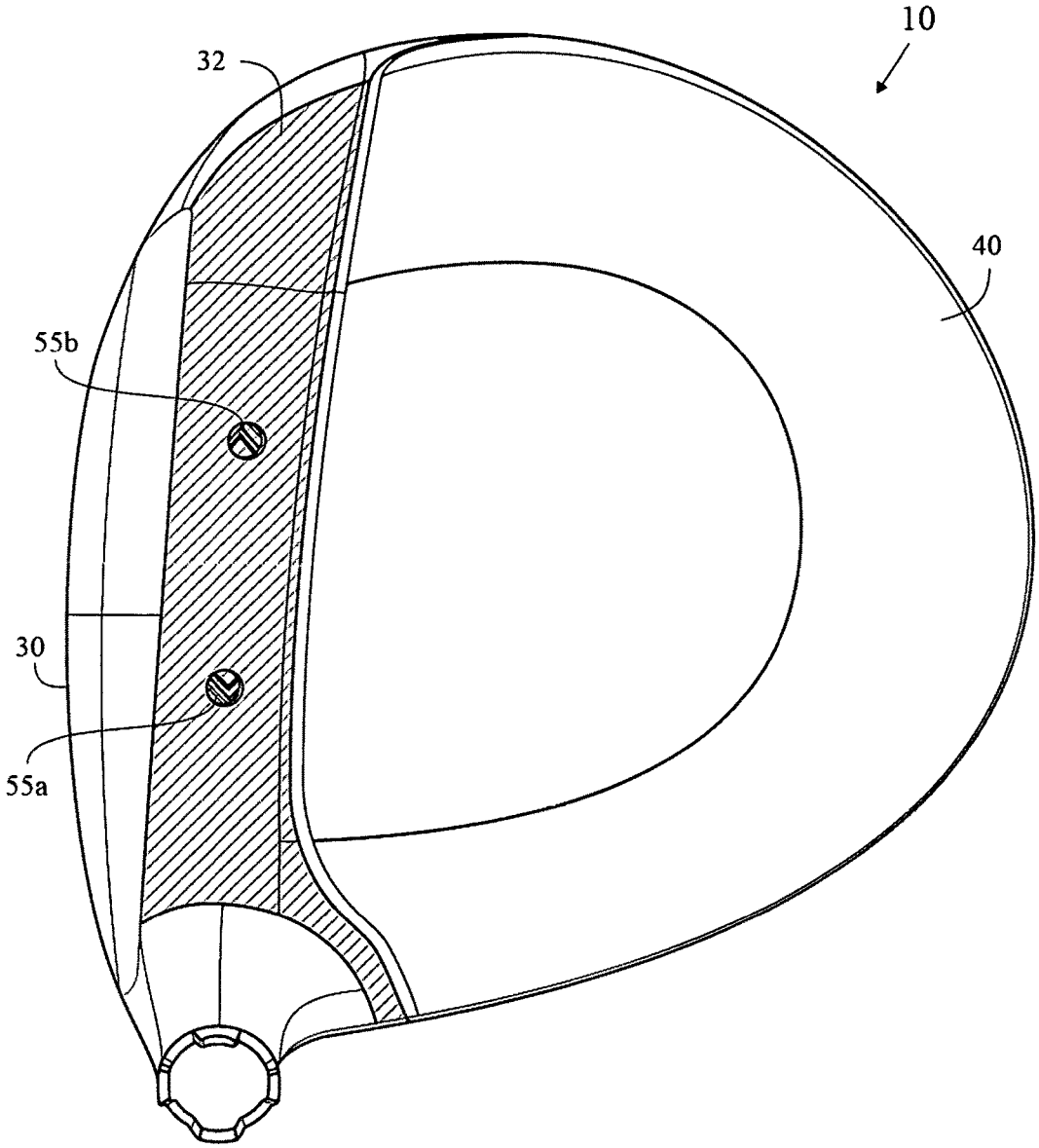
FIG. 14 is a top plan view of a golf club head.
Figure 14A:
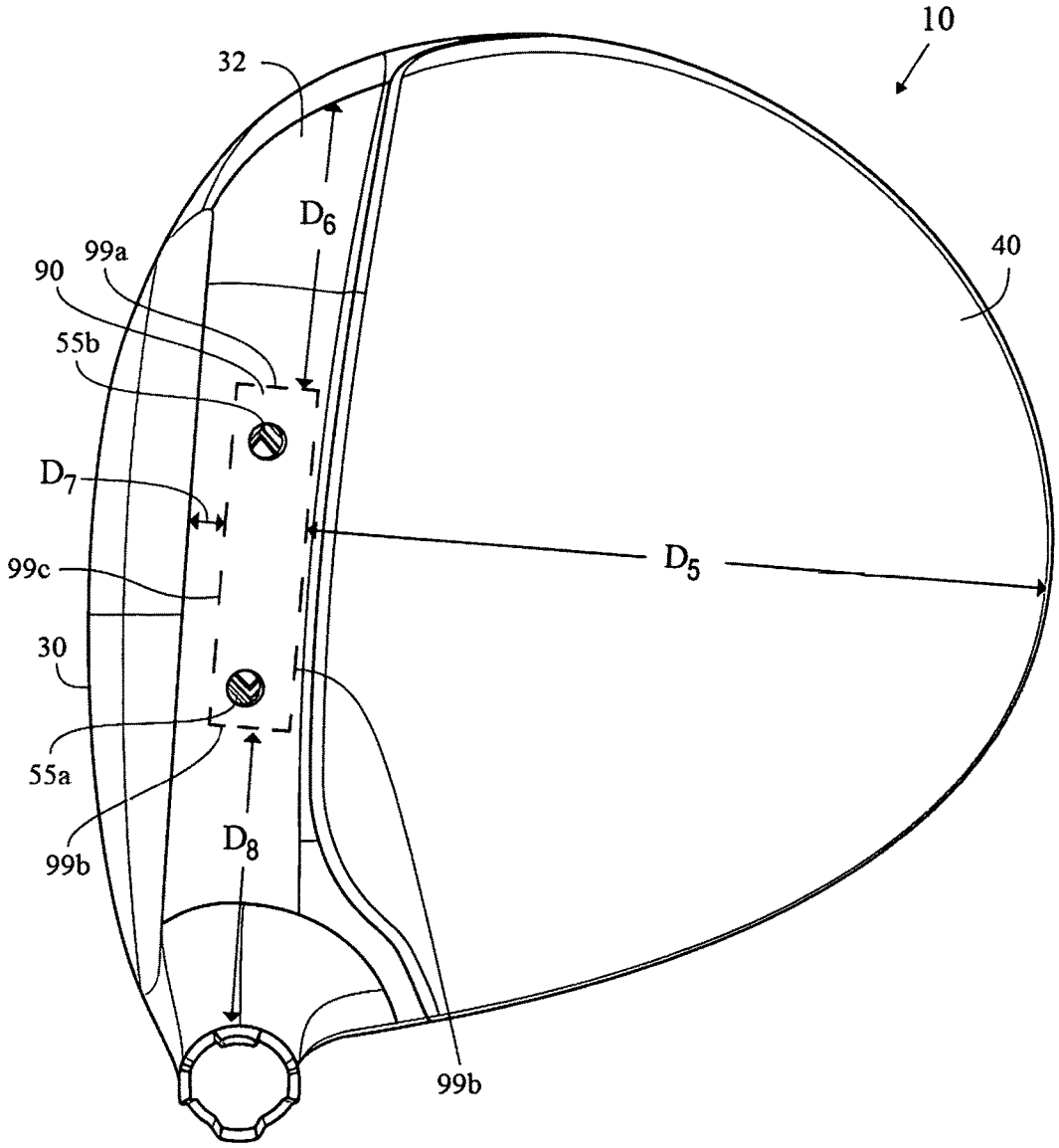
FIG. 14A is a top plan view of a golf club head with an imaginary rectangle encompassing the structural columns.
Figure 15:
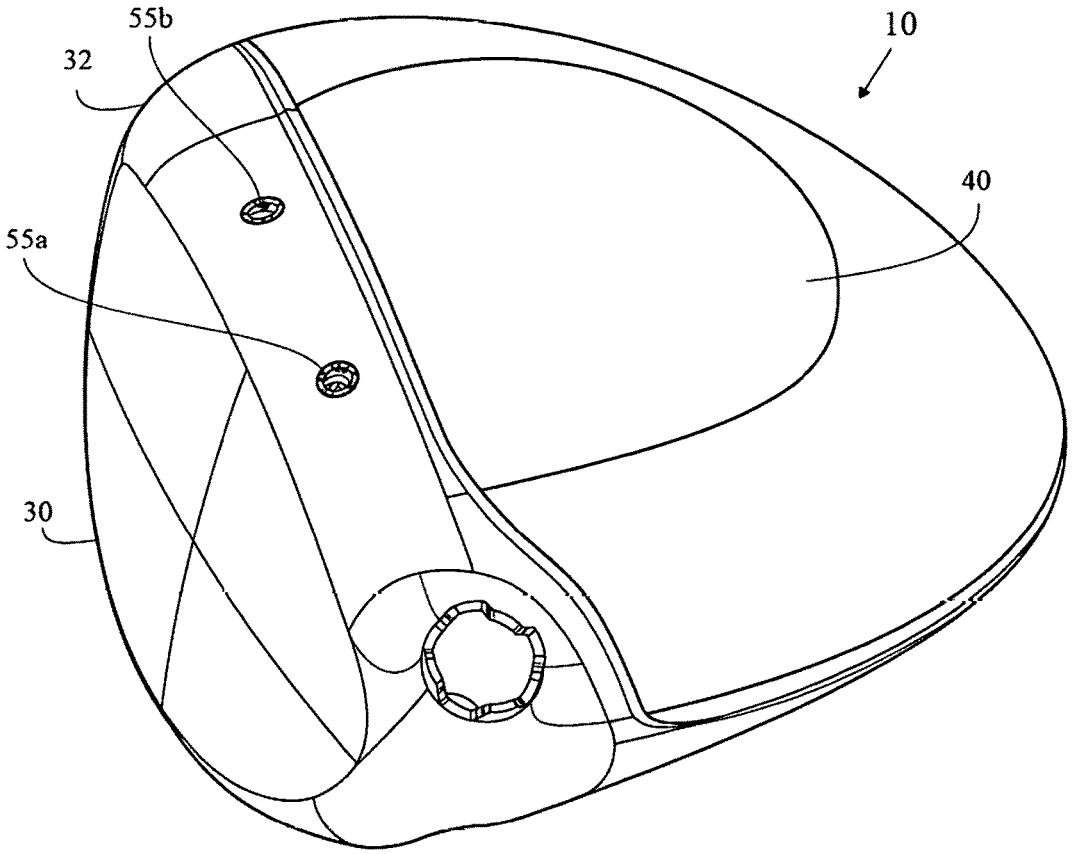
FIG. 15 is a top perspective view of a golf club head.
Figure 16:
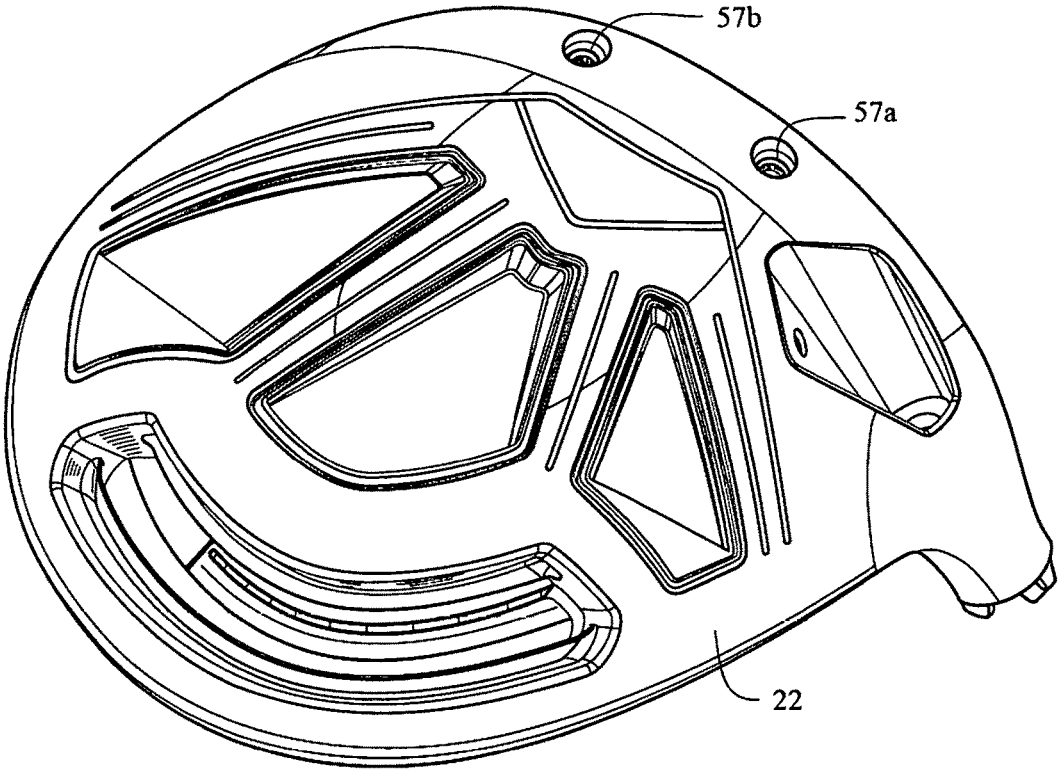
FIG. 16 is a bottom perspective view of a golf club head.

As shown in FIGS. 3*b*, 5B and 14A, in a preferred embodiment, the heel structural column 50 is preferably a distance from the heel end 23 ranging from 1.5 inches to 2.5 inches. The toe structural column 52 is preferably a distance from the toe end 25 ranging from 1.5 inches to 2.5 inches. The forward surface 50*c*, 52*c* of each of the toe structural column 52 and the heel structural column 50 is at least 0.120 inch rearward from the interior surface 36 of the striking face section 30. The rearward surface 50*d*, 52*d* of each of the toe structural column 52 and the heel structural column 50 is at least 3.5 inches forward from the aft end 28.

Figure 20:
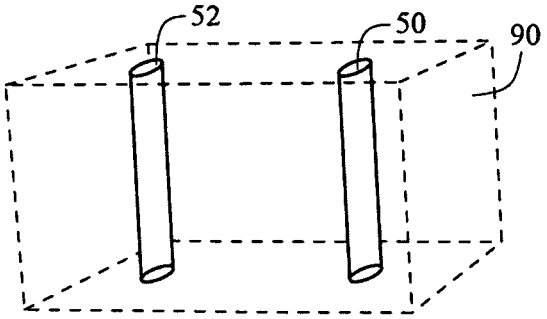
FIG. 20 is an isolated top perspective view of the structural columns encompassed by an imaginary cube.
Figure 21:
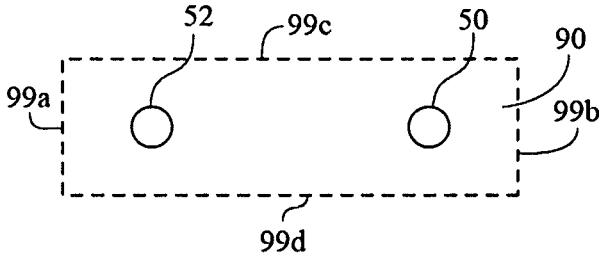
FIG. 21 is an isolated top plan view of the structural columns encompassed by an imaginary cube.

In an alternative embodiment, as shown in FIGS. 20-21, wherein each of a plurality of structural columns is positioned within an imaginary cube defined by crown return portion, the sole section, a distance of 1.5 inches from the heel end 23 of the metal body, a distance of 1.5 inches from the toe end 25 of the metal body, a distance of 3.5 inches from the aft end 28 of the metal body, and a distance of 0.120 inch rearward from the interior surface of the striking face section.

In each of the embodiments disclosed herein, the striking face section 30 preferably has a varying thickness such as that described in U.S. Pat. No. 7,448,960, for a Golf Club Head With Variable Face Thickness, which pertinent parts are hereby incorporated by reference. Other alternative embodiments of the thickness of the striking face section 30 are disclosed in U.S. Pat. No. 6,398,666, for a Golf Club Striking Plate With Variable Thickness, U.S. Pat. No. 6,471,603, for a Contoured Golf Club Face and U.S. Pat. No. 6,368,234, for a Golf Club Striking Plate Having Elliptical Regions Of Thickness, all of which are owned by Callaway Golf Company and which pertinent parts are hereby incorporated by reference. Alternatively, the striking face section 30 may have a uniform thickness.

In each of the embodiments disclosed herein, the body 20 is preferably cast from molten metal in a method such as the well-known lost-wax casting method. The metal for casting is preferably titanium or a titanium alloy such as 6-4 titanium alloy, alpha-beta titanium alloy or beta titanium alloy for forging, and 6-4 titanium for casting. Alternatively, the body 20 is composed of 17-4 steel alloy. Additional methods for manufacturing the body 20 include forming the body 20 from a flat sheet of metal, super-plastic forming the body from a flat sheet of metal, machining the body 20 from a solid block of metal, electrochemical milling the body 20 from a forged pre-form, casting the body using centrifugal casting, casting the body 20 using levitation casting, and like manufacturing methods.

In other embodiments, the golf club head 10 may have a multi-material composition such as any of those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A golf club head comprising:

a body comprising a striking face section, a sole section extending from a lower edge of the striking face section, and a crown section extending from an upper edge of the striking face section, the striking face section, sole section, and crown section defining a hollow body interior; and a plurality of structural columns disposed within the hollow body interior and extending from the crown section to the sole section, wherein a crown end of each of the plurality of structural columns is connected to the crown section and a sole end of each of the plurality of structural columns is connected to the sole section, wherein the striking face section comprises a rear face surface facing the hollow body interior, wherein each of the plurality of structural columns is located no more than 1 inch from the rear face surface along a vertical plane extending through the face center perpendicular to the striking face section, wherein each of the plurality of structural columns has a diameter of 0.050 inch to 0.200 inch, wherein each of the plurality of structural columns has an upper end and a lower end, wherein the upper end of each of the plurality of structural columns is located closer to the rear surface than the respective lower end of each of the plurality of structural columns, wherein the plurality of structural columns extend approximately parallel to one another and are spaced from one another by a distance of 0.500 inch to 2.000 inch;

wherein no portion of each of the plurality of structural columns makes contact with the striking face section when the striking face section impacts a golf ball, wherein the positioning of each of the plurality of structural columns improves the normalized ball speed ($V_{ballnorm}$) relationship to characteristic time (CT), and wherein the plurality of structural columns attenuates movement of the crown section and the sole section when the striking face section impacts a golf ball.

2. The golf club head of claim 1, wherein the plurality of structural columns comprises a heel structural column and a toe structural column, and wherein the heel structural column is spaced a distance of 0.75 inch to 1.50 inches from the toe structural column.

3. The golf club head of claim 2, wherein each of the heel and toe structural columns comprises a structure selected from the group consisting of a solid rod and a hollow tube.

4. The golf club head of claim 3, wherein each of the heel and toe structural columns is a solid rod, and wherein the solid rod is composed of a metal material selected from the group consisting of titanium alloy and steel.

5. The golf club head of claim 1, wherein the plurality of structural columns is located no more than 0.25 inch from the rear face surface along the vertical plane extending through the face center perpendicular to the striking face section.

6. The golf club head of claim 1, wherein the plurality of structural columns is positioned within an imaginary cube defined by the crown section, the sole section, a distance of 1.5 inches from a heel end of the body, a distance of 1.5 inches from a toe end of the body, a distance of 3.5 inches from an aft end of the body, and a distance of 0.120 inch rearward from the rear face surface of the striking face section.

7. The golf club head of claim 1, further comprising a cover piece, wherein the sole section comprises a plurality of cutouts, wherein each of the plurality of cutouts is an opening in communication with the hollow body interior, and wherein the cover piece is permanently affixed to a surface of the sole section so that a portion of the cover piece extends over and covers each of the plurality of cutouts.

8. The golf club head of claim 1, further comprising a crown insert, wherein the crown section comprises an upper opening, and wherein the crown insert is affixed to a surface of the crown section so that a portion of the crown insert extends over and covers the upper opening.

9. A golf club head comprising:

a metal body comprising a hollow body interior, a striking face section having a rear face surface facing the hollow body interior, a sole section extending from a lower edge of the striking face section, an upper opening, and a return section extending from an upper edge of the striking face section, the return section disposed between the striking face section and the upper opening; and a plurality of solid metal structural columns disposed within the hollow body interior and extending from the return section to the sole section, wherein a crown end of each of the plurality of structural columns is connected to the return section and a sole end of each of the plurality of structural columns is connected to the sole section, wherein each of the plurality of structural columns is positioned within an imaginary cube defined by the return section, the sole section, a distance of 1.5 inches from a heel end of the metal body, a distance of 1.5 inches from a toe end of the metal body, a distance of 3.5 inches from an aft end of the metal body, and a distance of 0.120 inch rearward from the rear face surface of the striking face section, wherein each of the plurality of structural columns has a diameter of 0.050 inch to 0.200 inch, wherein each of the plurality of structural columns has an upper end and a lower end, wherein the upper end of each of the plurality of structural columns is located closer to the rear face surface than the respective lower end of each of the plurality of structural columns, wherein the plurality of structural columns extend approximately parallel to one another and are spaced from one another by a distance of 0.500 inch to 2.00 inch, wherein no portion of the at least one structural column makes contact with the striking face section when the striking face section impacts a golf ball, wherein the positioning of each of the plurality of structural columns improves the normalized ball speed ($V_{ballnorm}$) relationship to characteristic time (CT), and wherein the plurality of structural columns attenuates movement of the return section and the sole section when the striking face section impacts a golf ball.

10. The golf club head of claim 9, further comprising a crown insert, wherein the crown insert is permanently affixed to a surface of the body so that a portion of the crown insert extends over and covers the upper opening.

11. The golf club head of claim 10, wherein the crown insert is composed of a carbon composite material.

12. The golf club head of claim 9, wherein each of the plurality of structural columns is integrally cast with the body.

13. The golf club head of claim 9, further comprising a carbon composite cover piece, wherein the sole section comprises a cutout in communication with the hollow body interior, and wherein the cover piece is permanently affixed to a surface of the sole section so that a portion of the cover piece extends over and covers the cutout.

14. The golf club head of claim 9, wherein each of the plurality of structural columns has a length of 1.00 inch to 2.50 inches.

15. The golf club head of claim 9, wherein a contact area between the return section and each of the plurality of structural columns ranges from 0.02 square inch to 0.04 square inch.

16. A golf club head comprising:

a titanium alloy body comprising a hollow body interior, a striking face section having an exterior surface and a rear face surface facing the hollow body interior, a sole section extending from a lower edge of the striking face section, an upper opening, a heel end, a toe end, an aft end, and a return section extending from an upper edge of the striking face section, the return section disposed between the striking face section and the upper opening; and a plurality of structural columns disposed within the hollow body interior and extending from the return section to the sole section, wherein a crown end of each of the plurality of structural columns is connected to the return section and a sole end of each of the plurality of structural columns is connected to the sole section, wherein each of the plurality of structural columns is positioned within an imaginary cube defined by the return section, the sole section, a distance of 1.5 inches from the heel end, a distance of 1.5 inches from the toe end, a distance of 3.5 inches from the aft end, and a distance of 0.120 inch rearward from the rear face surface, wherein each of the plurality of structural columns has a diameter of 0.050 inch to 0.200 inch, wherein each of the plurality of structural columns has an upper end and a lower end, wherein the upper end of each of the plurality of structural columns is located closer to the rear face surface than the respective lower end of each of the plurality of structural columns, wherein the plurality of structural columns extend approximately parallel to one another and are spaced from one another by a distance of 0.500 inch to 2.00 inch, wherein no portion of the plurality of structural columns makes contact with the striking face section when the striking face section impacts a golf ball, wherein the plurality of structural columns attenuates movement of the return section and the sole section when the striking face section impacts a golf ball, wherein the positioning of each of the plurality of structural columns improves the normalized ball speed ($V_{ballnorm}$) relationship to characteristic time (CT), and wherein the golf club head has a volume of 420 cubic centimeters to 470 cubic centimeters.

17. The golf club head of claim 16, wherein the plurality of structural columns occupies a volume of 0.1% to 1.0% of an internal volume of the golf club head.

18. The golf club head of claim 16, wherein a contact area between the return section and the plurality of structural columns ranges from 0.02 square inch to 0.04 square inch.

19. The golf club head of claim 16, wherein the plurality of structural columns comprises at least one arc surface having a radius of curvature ranging from 0.02 inch to 0.1 inch.

* * * * *